US012281436B2

(12) United States Patent
Bhatnagar

(10) Patent No.: US 12,281,436 B2
(45) Date of Patent: Apr. 22, 2025

(54) SUSTAINABLE FABRIC PREPARATION PROCESS FOR DYEING WITH BOTANICAL (PLANT) DYES

(71) Applicant: Target Brands, Inc., Minneapolis, MN (US)

(72) Inventor: Avinash S. Bhatnagar, Apple Valley, MN (US)

(73) Assignee: Target Brands, Inc., Minneapolis, MN (US)

( * ) Notice: Subject to any disclaimer, the term of this patent is extended or adjusted under 35 U.S.C. 154(b) by 279 days.

(21) Appl. No.: 17/368,953

(22) Filed: Jul. 7, 2021

(65) Prior Publication Data

US 2023/0010719 A1 Jan. 12, 2023

(51) Int. Cl.

| | |
|---|---|
| ***D06P 5/22*** | (2006.01) |
| ***D06B 21/00*** | (2006.01) |
| ***D06F 60/00*** | (2009.01) |
| ***D06P 1/34*** | (2006.01) |

(52) U.S. Cl.
CPC ..... *D06P 5/22* (2013.01); *D06B 21/00* (2013.01); *D06F 60/00* (2013.01); *D06P 1/34* (2013.01)

(58) Field of Classification Search
CPC ... D06P 5/22; D06P 1/34; D06B 21/00; D06F 60/00
See application file for complete search history.

(56) References Cited

FOREIGN PATENT DOCUMENTS

| | | | | |
|---|---|---|---|---|
| BR | 9712489 | * | 10/1999 | ..... D06M 16/003 |
| CN | 1443237 | * | 9/2003 | ..... C12N 9/88 |
| CN | 101481880 | * | 7/2009 | |
| CN | 101929045 A | | 12/2010 | |
| CN | 101929064 | * | 12/2010 | |
| CN | 104894891 | * | 9/2015 | |
| CN | 104894891 A | | 9/2015 | |
| KR | 101268908 B1 | | 5/2013 | |
| KR | 102234358 | * | 4/2021 | ..... D06M 15/3568 |
| WO | WO 00/71808 | * | 11/2000 | ..... D06P 3/60 |

OTHER PUBLICATIONS

Ethical Unicom: A Beginner's Guide to Natural Plant Dyeing, https://ethicalunicorn.com/2017/11/13/a-beginners-guide-to-natural-plant-dyeing/, 10 pages, Nov. 2017.
Little Green Dot: How to Dye Fabric with Natural Dyes, https://littlegreendot.com/how-to-dye-fabric-with-natural-dyes/, 10 pages, Accessed Apr. 23, 2021.
Samanta et al., Review Article, Application of Natural Dyes on Textiles, Indian Journal of Fibre & Textile Research, vol. 34, pp. 384-399, Dec. 2009.

* cited by examiner

*Primary Examiner* — Amina S Khan
(74) *Attorney, Agent, or Firm* — Amanda M. Prose; Westman, Champlin & Koehler, P.A.

(57) ABSTRACT

A process for preparing a natural fiber fabric for finishing the fabric with a botanical dye or printing content on the fabric with a botanical dye includes washing the natural fiber fabric in a washing solution comprising approximately equal parts washing soda and baking soda dissolved in water and rinsing the washed natural fiber fabric. The process also includes pre-treating the washed natural fiber fabric with a pre-treating solution comprising a bio enzyme in water and rinsing the pre-treated natural fiber fabric. After pre-treating, a pH of the washed and pre-treated the fabric load may be neutralized with a solution comprising vinegar in water.

11 Claims, 5 Drawing Sheets

SUSTAINABLE FABRIC PREPARATION PROCESS FOR DYEING WITH BOTANICAL (PLANT) DYES

BACKGROUND

Preparing fabrics in advance of dyeing the fabrics generally includes scouring, bleaching, and mercerizing the fabric using various chemical solutions to prepare the fabric. Natural fiber fabrics such as cotton are prepared in advance of dying in substantially the same manner as synthetic fabrics. Preparation of the fabric is essential to ensure complete and proper dyeing. Many of the issues with color fastness and evenness of coloring are the result of inadequate fabric preparation.

In prior art methods, scouring improves absorbency of the fabric and removes impurities. Scouring solutions for cotton fibers includes soda ash and surfactant in addition to other chemicals. Bleaching provides a uniform color in the fabric to allow for bright or vibrant colors to be achieved when dyed. Bleaching most commonly uses a solution of hydrogen peroxide with an alkali, stabilizer, sequestrant and a surfactant. Further, mercerizing changes the structure of the cotton fibers to alter the appearance and physical structure of the fabric and uses a concentrated solution of caustic soda. Each of these chemicals are harsh, non-sustainable chemicals for treating the fabric and require treatment of the water before draining or eventually entering a waste-water stream after use.

The discussion above is merely provided for general background information and is not intended to be used as an aid in determining the scope of the claimed subject matter. The claimed subject matter is not limited to implementations that solve any or all disadvantages noted in the background.

SUMMARY

A process for preparing a fabric load for a subsequent dye process includes providing a washing solution comprising washing soda and baking soda in water and washing the fabric with the washing solution. The process also includes providing a pre-treating solution comprising pectate lyase in water and pre-treating the fabric with the pre-treating solution. The fabric is rinsed and dried.

The washing solution includes washing soda in an amount that is in the range of approximately 6% to approximately 10% of a weight of the dry fabric load, baking soda in an amount that is in the range of approximately 6% to approximately 10% of the weight of the dry fabric load, and a liquor ratio for washing is 1:6. The amount of washing soda and baking soda may be substantially equal, or the amounts may be different.

The temperature of the washing solution during washing is raised to about 110° C. and maintained for a duration of washing the fabric load with the washing solution, the duration being approximately 60 minutes.

The pre-treating solution is added to the fabric in water at a liquor ratio of 1:6 and the pre-treating solution comprises pectate lyase in an amount in the range of approximately 1% to approximately 2% of the weight of the dry fabric load.

The fabric load is pre-treated with the temperature raised to about 55° C. and maintained a duration of pre-treating the fabric load with the pre-treating solution, the duration being approximately 30 minutes or more.

The fabric load is rinsed through at least one rinse cycle after washing the fabric load and at least one rinse cycle after pre-treating the fabric load.

Drying the fabric load includes heating the fabric load in a drying chamber heated to about 160° C.

The fabric load is softened while drying by adding a cationic hydrophilic softener to the fabric load while drying the fabric load.

The washing solution is pre-dissolved washing soda and pre-dissolved baking soda added to the fabric load and water in a liquor ratio of 1:6 and wherein a pH of the washing solution is in the range of approximately 8.0 to approximately 8.5.

The pre-treating solution is pre-dissolved pectate lyase added to the fabric load and water in a liquor ratio of 1:6 and wherein a pH of the pre-treating solution is in a range of approximately 7 to approximately 8.

The pH of the fabric load is checked and adjusted as needed to attain a pH of 7+/−0.50 prior to drying, by soaking the fabric load in a solution of vinegar and water.

The fabric is a natural fiber fabric.

The process is carried out in advance of subsequent finishing of the fabric load with a botanical or plant-based dye, where finishing comprises dyeing, printing on the fabric, or a combination of both, with the plant-based dye.

A process for preparing a natural fiber fabric for finishing with a botanical dye includes washing the natural fiber fabric in a washing solution comprising approximately equal parts washing soda and baking soda dissolved in water and rinsing the washed natural fiber fabric. The process also includes pre-treating the washed natural fiber fabric with a pre-treating solution comprising a bio enzyme in water and rinsing the pre-treated natural fiber fabric. After pre-treating, a pH of the washed and pre-treated the fabric load may be neutralized with a solution comprising vinegar in water.

The process includes softening the natural fiber fabric during drying with a cationic hydrophilic fabric softener.

Rinsing the washed natural fiber fabric includes a first rinse cycle with a duration of at least 5 minutes; and one or more subsequent rinse cycles each with a duration of at least 3 minutes.

Rinsing the pre-treated natural fiber fabric includes a first rinse cycle with a duration of at least 5 minutes; and one or more subsequent rinse cycles each with a duration of at least 3 minutes.

Washing the natural fiber fabric includes heating the washing solution to at least 110° C. and washing the natural fiber fabric for at least 60 minutes.

Pre-treating the natural fiber fabric includes heating the pre-treating solution to at least 55° C. and washing the natural fiber fabric for at least 60 minutes.

The natural fiber fabric is dried at a temperature of about 160° C.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

Figure 1:
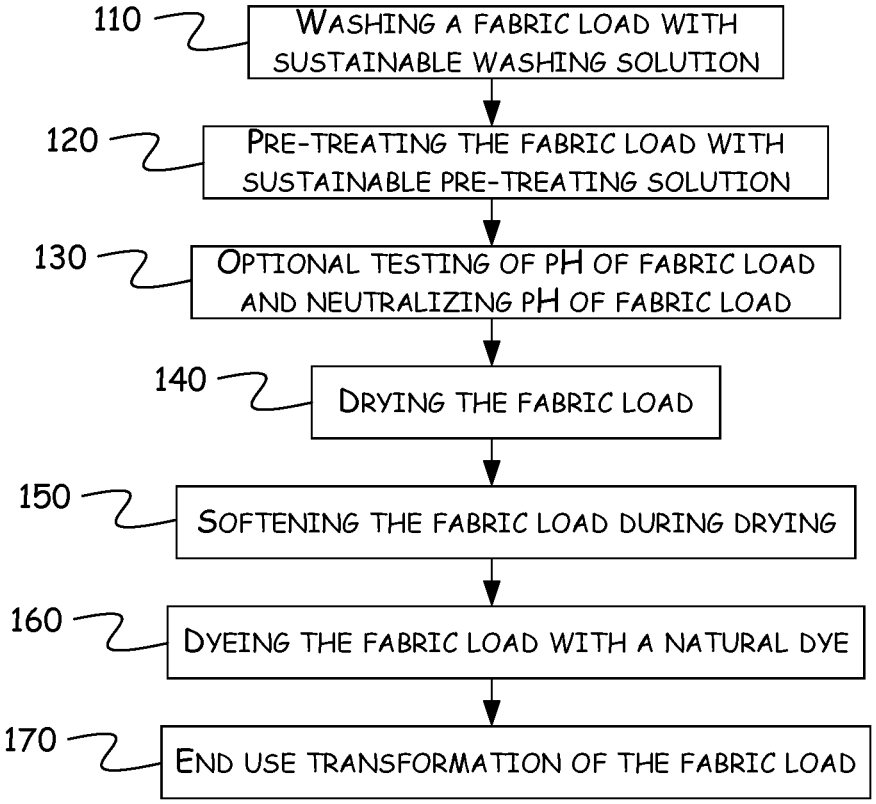
FIG. 1 is a flow diagram of a process for preparing a natural fiber fabric for subsequent finishing with a botanical dye.

Existing preparation methods for natural fiber textiles, or fabrics, in advance of dyeing the textile or fabric with a natural, plant based (botanical) dye are limited to the same, traditional procedures for preparing natural fibers for standard dye processes. These current methods retain the use of harsh chemicals to prepare the fibers for botanical dyeing.

The natural fiber fabrics are dyed with a natural dye and transformed for an end use such as an accessory or garment. These fabrics are marketed as "natural" or "sustainably produced" fabrics based on the fiber and dye; however, the preparation process is not actually natural or sustainably based.

Embodiments described below improve the overall sustainability of the natural fiber fabric by way of providing a preparation process that uses only sustainable materials and processes for preparing the natural fiber fabric in advance of natural dyeing. The processes eliminate the use of caustic and harsh chemicals such as sodium sulfate, caustic soda, and hydrogen peroxide to prepare the natural fibers for natural dyeing. The process of preparing the fabric thus allows for a truly sustainable garment, accessory, or other natural fiber fabric product to be produced. The processes include washing the natural fiber fabric with a sustainable washing composition and pre-treating the fabric with a sustainable pre-treatment composition. The natural fiber fabric can be softened while dried with a sustainable fabric softener. A pH of the natural fiber fabric can also be adjusted during preparation with a sustainable neutralizer.

The processes described herein are used for preparing natural fiber fabrics for finishing and can be used on a commercial production scale. Natural fiber fabrics are those textiles constructed from natural fibers only. What is meant by natural fibers is any hairlike raw material directly obtainable from a plant, animal, vegetable, or mineral source and that can be converted into woven or non-woven fabrics. Examples include but are not limited to cotton, linen, wool, or silk. By preparing the natural fiber fabric with the sustainable compositions of the embodiments below, in advance of using natural dyes to finish the textile, the fabric preparation process compliments the natural characteristics of botanical dyes and maintains sustainability across preparation and dying of and/or printing on the textile with a botanical dye. What is meant by "finishing" the textile is dyeing, screen printing, graphic printing, otherwise adding a design element, or a combination thereof, to the fabric or textile with a botanical or plant-based dye.

The preparation processes described herein improve dyeability of the fabric by increasing color yield and reduce dye consumption by 50% to 60% over fabrics treated with traditional processes.

The preparation processes described herein further improve wash fastness properties of dyed fabrics as compared to fabrics treated with traditional preparation processes in advance of dyeing.

The preparation processes described herein further result in a reduction in water consumption by reducing the water needed during the traditional preparation steps described previously above, which also corresponds to an energy and time savings in preparation of the natural fiber fabrics.

As the washing composition and pre-treatment compositions include only sustainable chemicals in water, the effluent after washing and pre-treating does not include pollutants or harsh chemicals requiring treatment before discharge to prevent harsh chemicals from entering water sources.

As used throughout the disclosure, the term "liquor ratio" refers to the ratio of the weight of the dry material being dyed to the water weight of the bath. For example, a liquor ratio of 1:10 implies 1 kg of fabric to 10 L of water.

As used throughout the disclosure, the term "end use transformation" refers to the process of forming an article from the fabric, such as clothing, bedding, accessories, or other fabric-based goods. The end use transformation may be carried out before, after, or concurrently with preparing the fabric for finishing and/or dyeing and/or printing on the fabric. End use transformation may also be carried out at any time before undertaking one or more of the steps of the methods of preparing the fabric for dyeing or printing. For example, prior to end use transformation, the fabric supply may be referred to hereinafter as the "raw" fabric supply. The processes described herein may be carried out in substantially the same manner on raw or end use transformed natural fiber fabric.

As illustrated in FIG. 1, a process 100 of preparing a fabric for finishing comprises washing a fabric load with a sustainable washing solution at step 110. The fabric is also pre-treated with a sustainable pre-treating solution at step 120. After washing and pre-treating, the fabric load may have a non-neutral pH and in the event the fabric load requires neutralization, the fabric load can be neutralized with a sustainable neutralizing solution at step 130. The fabric load is then dried at step 140. The fabric can also be softened when drying at step 150. In one embodiment, after drying, the fabric load is ready for a finishing process (step 160) and end use transformation (step 170). Step 160 may include dyeing the fabric with the botanical dye, printing graphics on or otherwise applying graphics or design elements to the fabric with a botanical dye or combinations thereof.

Figure 2:
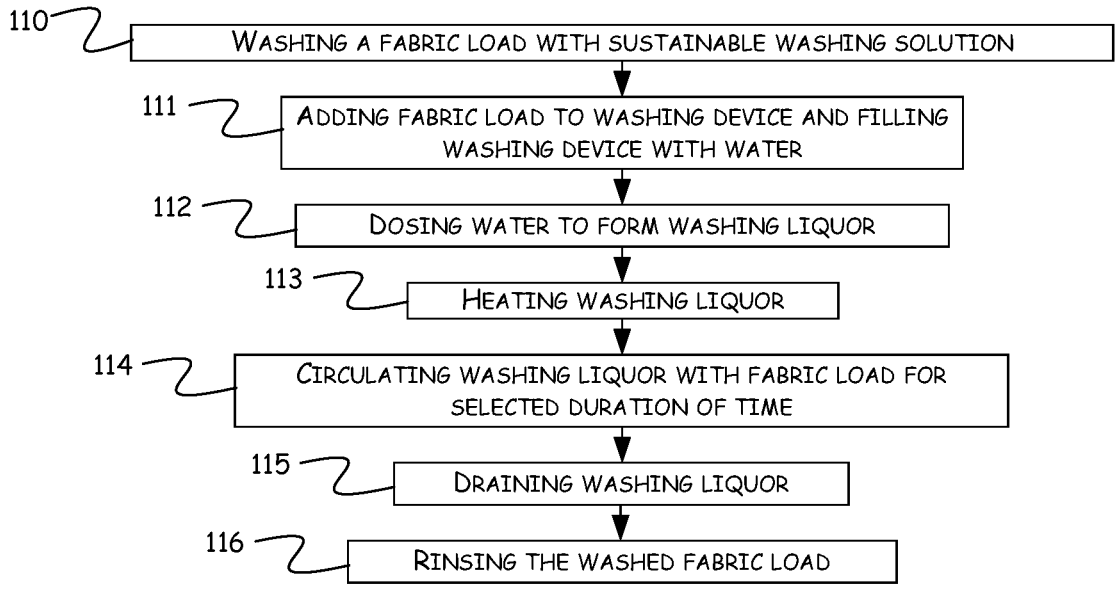
FIGS. 2-5 are flow diagrams of another embodiment of the process for preparing a natural fiber fabric for subsequent finishing with a botanical dye.

In further detail, as illustrated in FIGS. 2-5, and more specifically at FIG. 2, the process 100 for preparing a natural fiber fabric load for a natural dye process includes a washing step at 110 which comprises adding a fabric load to a washing device and filling the washing device with water at step 111. The amount of water added should be sufficient to circulate around the fabric load and to saturate the fabric load. For example, a liquor ratio for the fabric load at step 102 may be approximately 1:5 or greater, including 1:6, 1:7, 1:8, 1:9 or 1.10. The water may be cold water with a temperature in the range of about 15° C. to about 27° C.

The water is dosed with sustainable washing chemicals for form a sustainable washing liquor at step 112. Washing soda and baking soda are pre-dissolved and added to the water. In one or more embodiments, the washing soda and baking soda may be added in equal parts to the water. The amount of water is determined based on a dry weight of a fabric load which is the amount of fabric to be added to the water for washing. Similarly, amounts of washing soda and baking soda added to the water to form the washing liquor are also based on the dry weight of the fabric load. The amount of washing soda may be in the range of about 3% to about 12% of the dry weight of the fabric load, or more preferably in the range of about 5% to about 10% of the dry weight of the fabric load, or more preferably in the range of about 7% to about 8% of the dry weight of fabric load. The amount of baking soda may be in the range of about 3% to about 12% of the dry weight of the fabric load, or more preferably in the range of about 5% to about 10% of the dry weight of the fabric load, or more preferably in the range of about 7% to about 8% of the dry weight of fabric load. The washing liquor should have a pH in the range of about 8.0 to about 8.5.

Once the washing liquor is prepared and circulating with the fabric load therein, the washing liquor is heated at step 113. The washing liquor may be heated to about 110° C. and once heated, the fabric load is retained in the circulating, heated washing liquor for a selected duration of time that may be 30 minutes or more, 45 minutes or more, or 60 minutes or more at step 114.

After washing, the washing liquor is drained from the washing apparatus at step 115 and the fabric load is rinsed with clean water at step 116. The fabric load may be subject to a plurality of rinse cycles of the same or different durations. For example, a first rinse cycle may last five minutes while one or more subsequent rinse cycles last three minutes.

Figure 3:
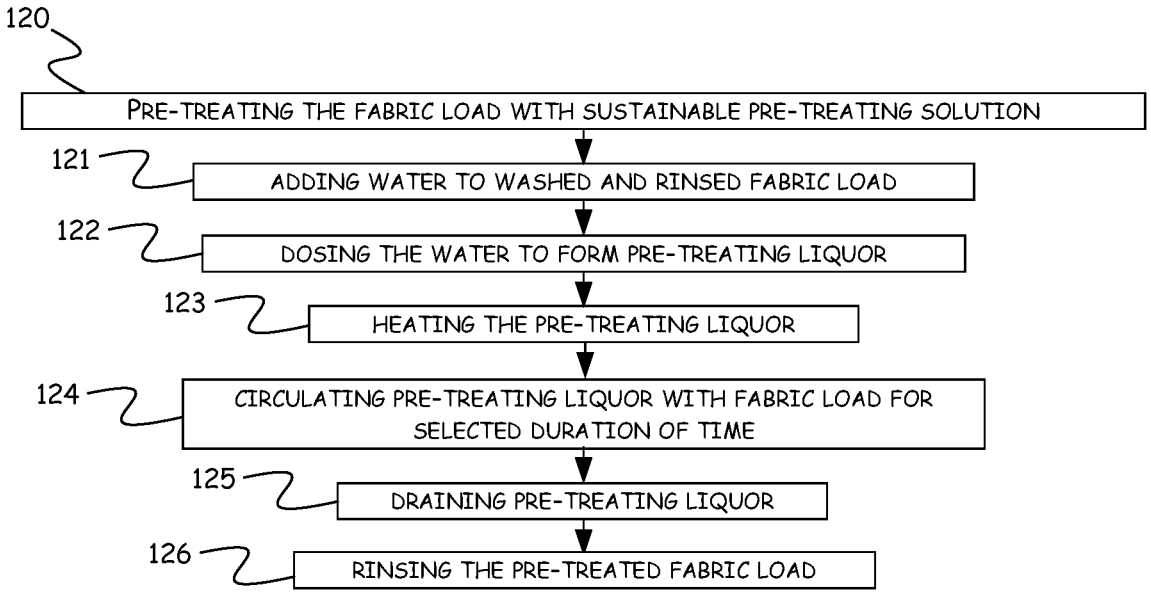

After washing and rinsing, the fabric load is pre-treated for dyeing at step 120 as illustrated in FIG. 3. The fabric load in a pre-treating apparatus is filled with water at step 121. The washing apparatus and pre-treating apparatus may be the same or different apparatuses. For example, the liquor ratio of 1:6 is again attained for pre-treatment. A bio enzyme is pre-dissolved and added to the liquor to form the pre-treating liquor at step 122. The bio enzyme may be added in an amount that achieves a pH of the pre-treatment liquor in the range of about 7 to about 8. For example, an amount of bio enzyme added may be based on the dry weight of the fabric load and be in the range of about 1% to 5% the dry weight of the fabric load, or more preferably about 1% to 2% of the dry weight of the fabric load. Examples of the bio enzyme include but are not limited to pectate lyase.

The temperature of the pre-treatment liquor may be raised or lowered to reach about 55° C. at step 123. The pre-treatment liquor is then circulated to pre-treat the fabric load for a selected duration of time that may be about 30 minutes or more at step 124.

After pre-treating, the pre-treating liquor is drained from the pre-treating apparatus at step 125 and the fabric load is rinsed with clean water at step 126. The fabric load may be subject to a plurality of rinse cycles of the same or different durations. For example, a first rinse cycle may last five minutes while one or more subsequent rinse cycles last three minutes.

Figure 4:
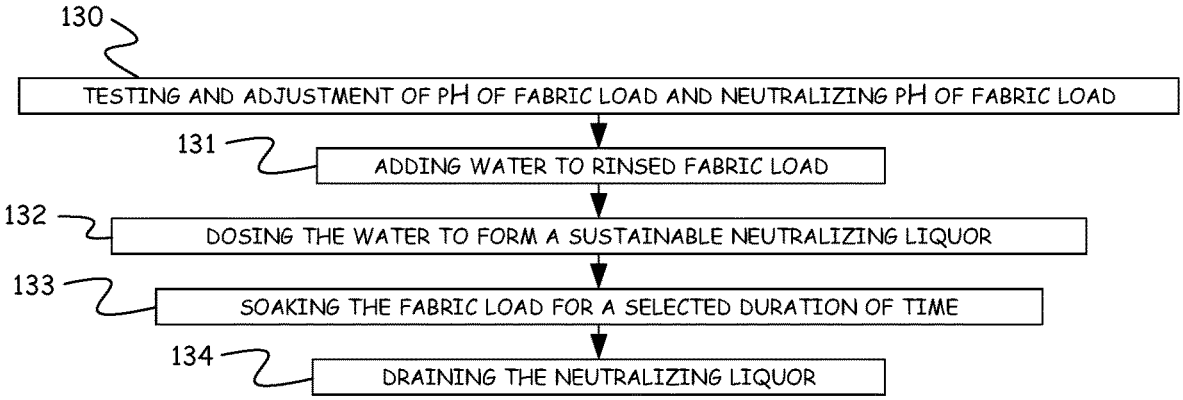

As illustrated in FIG. 4, after pre-treating, the pH of the fabric is checked and may be adjusted or neutralized as needed at step 130. For example, if the pH of the fabric is with +/−0.50 of a pH of 7, neutralization should be undertaken. The fabric can then be soaked in room temperature water at step 131 and vinegar added in amount of 1 g/L of water at step 132. This neutralization liquor is circulated, and the fabric load soaked for approximately 10 minutes at step 133. The pH is checked again before draining the neutralization liquor at 134.

Prior to drying the fabric load, a dry absorbency of a swatch of the fabric can be checked, and for example, in one embodiment, desired absorbency is about 3 seconds to indicate the fabric load is ready for drying.

Figure 5:
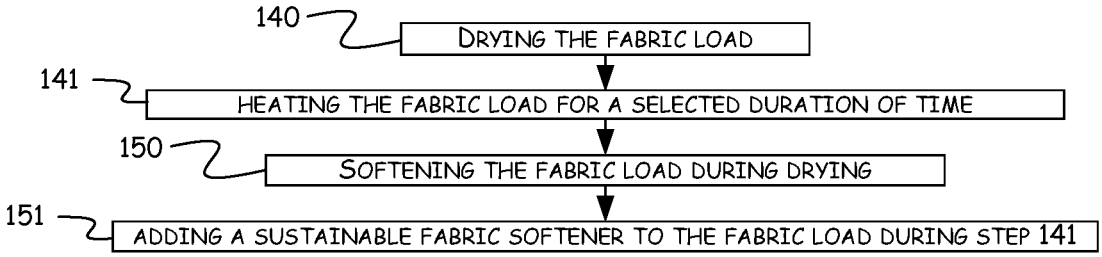

As illustrated in FIG. 5, the fabric load is dried at step 140 and optionally softened when dried at step 150. For example, softening may comprise treating the fabric with a cationic hydrophilic softener at step 151 in a heating chamber or dryer maintained at a temp of about 160° C. at step 141.

The natural fiber fabric is then ready for dyeing. The dyeing may be done with a natural dye such as a plant-based, or botanical, dye. The fabric is then ready for end use transformation into an accessory, a garment, bedding, or other end use. In one or more embodiments, the fabric load may be ready for dying after completion of step 134 and prior to dying at step 140. That is, a fabric load having a neutral pH, whether or not the neutralization steps as described above is required, may be dyed prior to drying as described herein.

In one or more embodiments, the fabric load may printed with botanical dyes to selectively apply graphics or text to the fabric load. The fabric load may be subject to this finishing step after drying of the fabric load is completed. In one or more embodiments, the fabric load may be dyed with the botanical dye prior to drying, the fabric load then dried, and a second finishing step carried out where the dyed and dried fabric load is then subject to a printing step to apply graphics or text to the fabric with the botanical dye. In one or more embodiments, the fabric may be prepared according to the steps described above and subjected to a finishing process which includes printing to apply graphics or text to the undyed fabric. After printing the process of steps 140 to 151 may be carried out on the finishing fabric.

Illustrative Example

A natural fiber fabric load having a dry weight of approximately 500 Kg is prepared for subsequent dyeing and end use transformation into a garment. The fabric load is washed first with a sustainable washing solution. The fabric load is added to a washing machine filled with cold water at a liquor ratio of 1:6. The water is circulated to saturate the fabric load. The water is dosed with pre-dissolved washing soda in an amount equal to approximately 37.5 Kg for the 500 Kg of Fabric and pre-dissolved baking soda in an amount equal to approximately 37.5 Kg for the 500 Kg of Fabric.

The pH of the washing solution is in the range of about 8.0 to about 8.5. The cold water is heated to 110° C. at a rate of about 2° C./minute. Once the temperature reaches approximately 110° C., the temperature is maintained for approximately 60 minutes. During this time, the water and washing solution, also referred to as the "washing liquor" is circulated to thoroughly wash the fabric load. The liquor is drained, and a first rinse cycle is initiated. The fabric is rinsed with clean water during the first rinse cycle having a duration of approximately 5 minutes. A second and third rinse cycle each having a duration of approximately 3 minutes are carried out.

After washing, the fabric load is pre-treated for increasing dyeability of the fabric with a botanical, or plant-based, dye. Pre-treating includes adding water to the washed and rinsed fabric load to attain a liquor ratio of 1:6. Pre dissolved pectate lyase is added to the liquor in an amount equal to approximately 1.5 Kg for the 500 Kg of fabric. The pH of the liquor should be in the range of approximately 7 to approximately 8. The temperature of the pre-treating liquor is brought to approximately 55° C. and maintained at 55° C. for approximately 30 minutes while again the liquor is circulated to pre-treat the entire fabric load thoroughly. The liquor is drained, and a first rinse cycle is initiated. The fabric is rinsed with clean water during the first rinse cycle having a duration of approximately 5 minutes. A second and third rinse cycle each having a duration of approximately 3 minutes are carried out.

After pre-treating, the pH of the fabric load is checked. If the fabric load has a pH greater than 7.5 or less than 6.5, the fabric load is neutralized. Neutralizing the fabric load comprises adding ambient temperature water to the fabric load to reach the 1:6 liquor ratio and 1 g/L of vinegar is added. The fabric load is soaked in the circulating neutralization liquor for approximately 10 minutes and the pH checked again. Neutralization can be repeated until the fabric load has a pH of 7+/−0.50. Absorbency of a dried swatch can be checked and should be about 3 seconds. The neutralization liquor is drained from the washing vessel and the fabric removed.

The fabric load is then dried for subsequent dyeing and end use transformation. The fabric is also softened during drying. The fabric load is added to a drying chamber along with 10 g/L of a cationic hydrophilic softener with a 40% pick up (with a pickup in the range of 35% to 45%). Drying is then carried out at a temperature of 160° C. and a stentor speed of 40 m/m.

The fabric load is then ready for dyeing and end use transformation which includes dying the fabric load with a plant-based dye.

Although this disclosure describes a method of preparing a fabric for finishing and/or end use transformation, it is contemplated and within the scope of this disclosure that the methods and processes described herein can be undertaken on fabric in article form thus already having undergone an end use transformation. The methods and processes described herein may also be used to prepare fabric for end use transformation or prepare an article already having undergone an end use transformation, without a finishing step. That is, the methods and processes herein can be used on a fabric in an end use form or pre-end use form and which may or may not be finished with a botanic dye.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms for implementing the claims.

What is claimed is:

1. A process for preparing a fabric load for a subsequent finishing process comprising:

providing a washing solution consisting of washing soda and baking soda in water and washing the fabric with the provided washing solution;

providing a pre-treating solution consisting of pectate lyase in water;

pre-treating the fabric with the pre-treating solution;

rinsing the fabric after pre-treating the fabric;

drying the fabric by heating the fabric load in a drying chamber to about 160° C., and softening the fabric load while drying the fabric load wherein softening comprises adding a cationic hydrophilic softener to the fabric load while drying the fabric load, wherein finishing comprises dyeing, printing content thereon, or a combination thereof and, wherein the process is carried out without the use of sodium sulfate, caustic soda or hydrogen peroxide.

2. The process of claim 1 wherein the washing solution comprises:

washing soda in an amount that is in the range of approximately 6% to approximately 10% of a weight of the dry fabric load;

baking soda in an amount that is in the range of approximately 6% to approximately 10% of the weight of the dry fabric load, and wherein a liquor ratio for washing is 1:6.

3. The process of claim 1 wherein the pre-treating solution is added to the fabric in water at a liquor ratio of 1:6 and wherein the pre-treating solution comprises pectate lyase in an amount in the range of approximately 1% to approximately 2% of the weight of the dry fabric load.

4. The process of claim 2 and further comprising washing the fabric load and concurrently raising the temperature during washing to about 110° C. and maintaining the 110° C. washing temperature for a duration of washing the fabric load with the washing solution, the duration being approximately 60 minutes.

5. The process of claim 3 and further comprising pre-treating the fabric load and concurrently raising the temperature during pre-treating to about 55° C. and maintaining the temperature at about 55° C. for a duration of pre-treating the fabric load with the pre-treating solution, the duration being approximately 30 minutes or more.

6. The process of claim 1 and further comprising rinsing the fabric load through at least one rinse cycle after washing the fabric load and at least one rinse cycle after pre-treating the fabric load.

7. The process of claim 1 wherein the washing solution comprises pre-dissolved washing soda and pre-dissolved baking soda added to the fabric load and water in a liquor ratio of 1:6 and wherein a pH of the washing solution is in the range of approximately 8.0 to approximately 8.5.

8. The process of claim 1 wherein the pre-treating solution comprises pre-dissolved pectate lyase added to the fabric load and water in a liquor ratio of 1:6 and wherein a pH of the pre-treating solution is in a range of approximately 7 to approximately 8.

9. The process of claim 1 and further comprising checking the pH of the fabric load and adjusting the pH to a pH of 7+/−0.50 prior to drying by soaking the fabric load in a solution of vinegar and water.

10. The process of claim 1 wherein the fabric is a natural fiber fabric.

11. The process of claim 10 wherein the process is carried out for subsequent dyeing of the fabric load, printing content thereon, or a combination thereof with a botanical or plant-based dye.

* * * * *